US007044312B2

(12) United States Patent
Yang

(10) Patent No.: US 7,044,312 B2
(45) Date of Patent: May 16, 2006

(54) MULTI-PURPOSE TUBULAR FRAME STRUCTURE

(76) Inventor: Hsin-Chen Yang, No. 378, Ton Chung Road, Pei, Ton Township, Changhua Hsien (TW)

( * ) Notice: Subject to any disclaimer, the term of this patent is extended or adjusted under 35 U.S.C. 154(b) by 104 days.

(21) Appl. No.: 10/461,375

(22) Filed: Jun. 16, 2003

(65) Prior Publication Data

US 2004/0251226 A1 Dec. 16, 2004

(51) Int. Cl.
*A47B 47/00* (2006.01)

(52) U.S. Cl. ..... 211/187

(58) Field of Classification Search ..... 211/187, 211/191, 192, 183; 108/107; 403/252, 263
See application file for complete search history.

(56) References Cited

U.S. PATENT DOCUMENTS 4,348,001 A * 9/1982 Baldwin ..... 248/243
4,996,929 A * 3/1991 Saal ..... 108/107
5,957,060 A * 9/1999 Rosenband ..... 108/107

* cited by examiner

*Primary Examiner*—Sarah Purol
(74) *Attorney, Agent, or Firm*—Rabin & Berdo, P.C.

(57) ABSTRACT

A multi-purpose tubular frame structure that is assembled by an interlocking conjoinment and, furthermore, provides for height adjustment. A plurality of retaining holes are formed in the corner posts of the invention herein and each retaining hole is a semi-trapezoidal opening with the sides at the lower half gradually angled inward such that cleat blocks disposed on a horizontal tube can be positionally engaged therein.

1 Claim, 23 Drawing Sheets

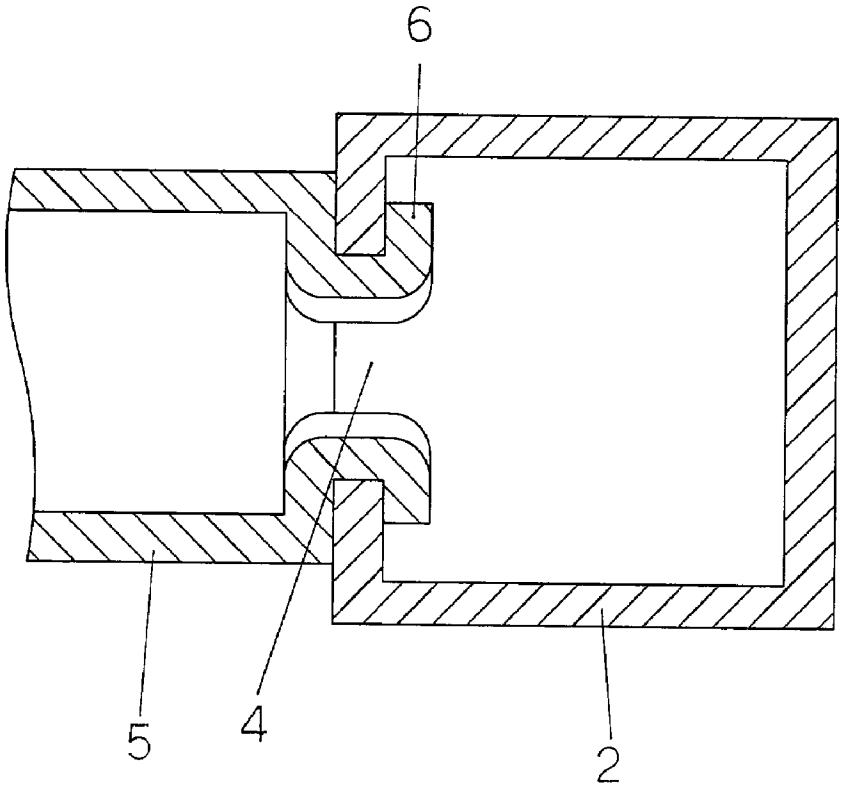
FIG.9-A

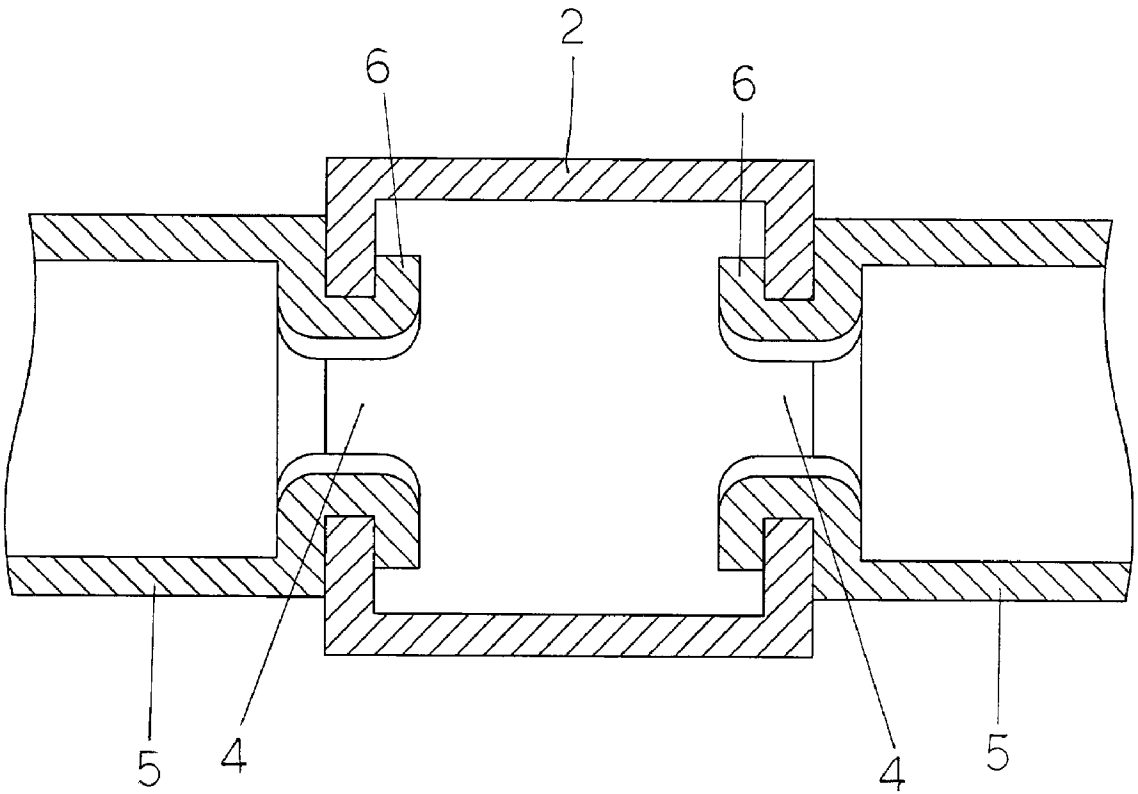
FIG.10-A

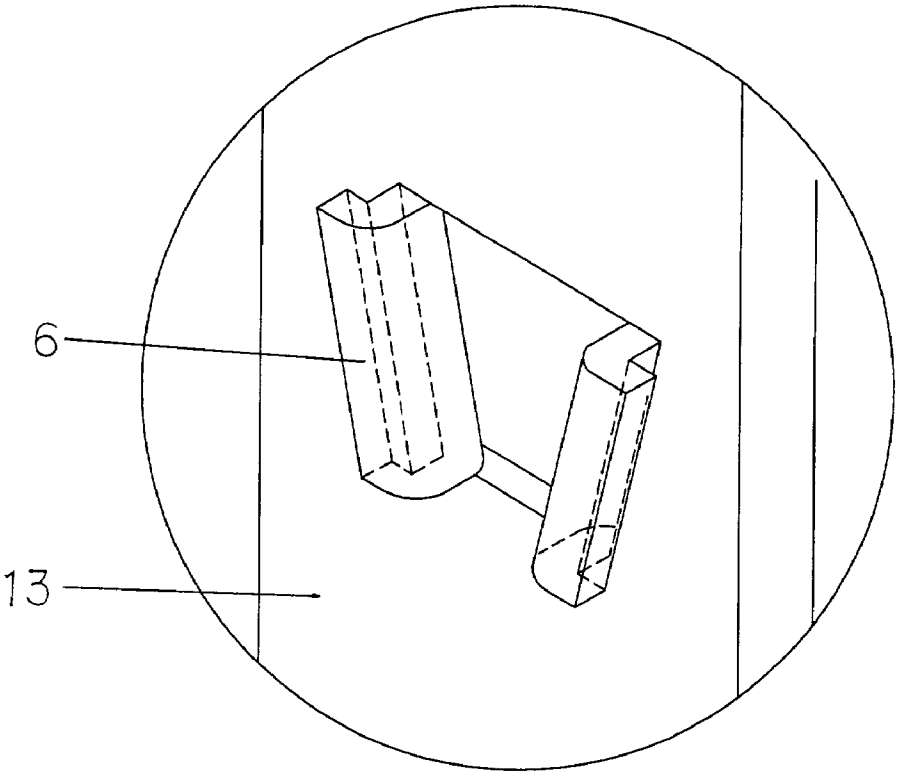
FIG.11-A

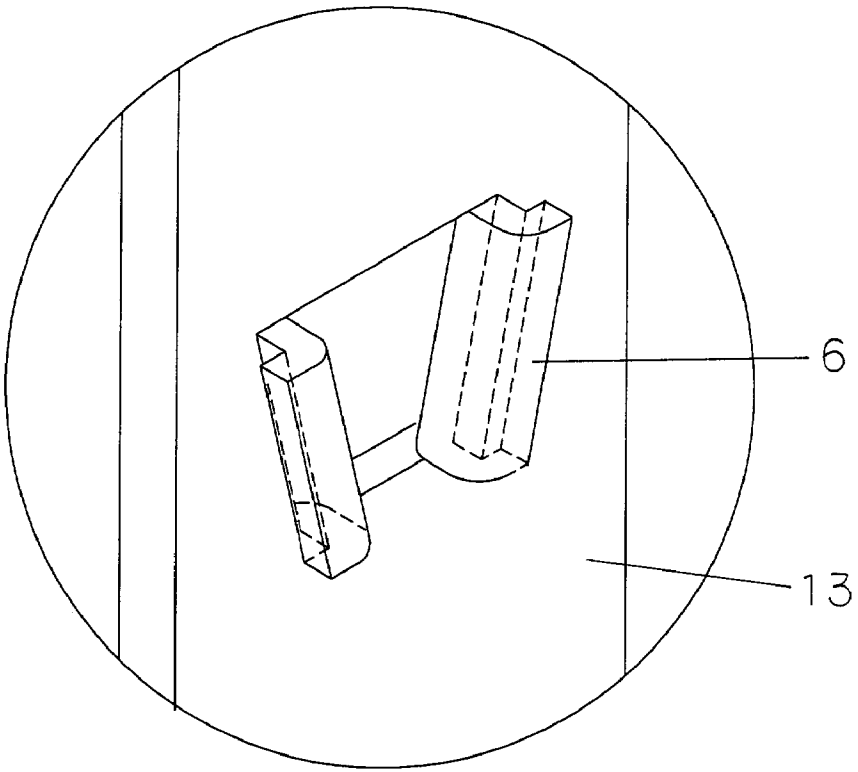
FIG.13-A

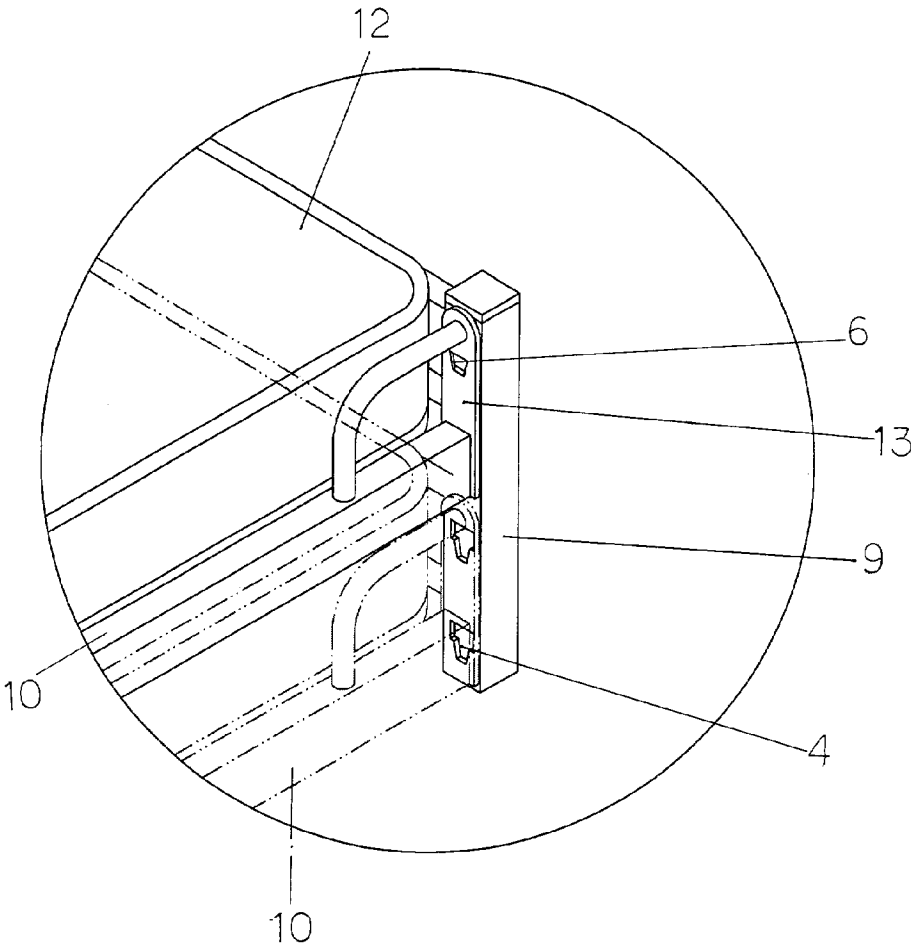
FIG.16-A

MULTI-PURPOSE TUBULAR FRAME STRUCTURE

BACKGROUND OF THE INVENTION

1) Field of the Invention

The invention herein relates to shelving and similarly configured systems, specifically a multi-purpose tubular frame structure.

2) Description of the Prior Art

Conventional and typical arrangements of assembly-type furniture structures:

(1) As indicated in FIG. 1 and FIG. 2, the isometric drawing of a conventional shelf rack and the exploded drawing of a section of the conventional shelf rack, a conventional shelf rack A consists of corner posts A1 and shelves A2 that are assembled together by means of tightened threaded fasteners A3 and, as such, since the shelves A2 are fixed in place after assembly, the height of the shelves A2 cannot be conveniently adjusted. When the user wants to vary the shelf height, tools must be utilized to disassemble the shelf rack and then re-assemble it once again following re-positioning; as a result, the height adjustment task is time consuming and, furthermore, complicated, which is a drawback.

(2) As indicated in FIG. 3, FIG. 4, and FIG. 5, the isometric drawing of a conventional bed, the exploded drawing of the conventional bed, and the isometric drawing of a section of conventional bed shown in a partial, magnified view, a conventional bed B is comprised of a mattress B1, a cushioning layer B2, and a frame B3, the frame B3 consisting of a plurality of square tubes B31 and support posts B3 that are welded together, with the cushioning layer B2 and the mattress B1 then situated on the frame B3. As such, since the frame B3 is welded into a permanent structure, when the conventional bed is shipped, it easily occupies more square area that adversely affects delivery and storage by increasing shipping costs, which are generally passed on to consumers, a situation that is not ideal and illustrates another drawback.

In view of the various shortcomings and inconveniences of the said conventional assembly-type furniture, the applicant of the invention herein undertook continuous research and development to remedy the drawbacks, enhance the marketability of the product, and further improve its functional utility, which culminated in the successful completion of the structure of the invention herein and the submitting of a new patent application.

SUMMARY OF THE INVENTION

The objective of the invention herein is provide a multi-purpose tubular frame structure that is assembled by an interlocking conjoinment and, furthermore, capable of height adjustment, wherein a plurality of retaining holes are formed in the corner posts of the invention herein and each retaining hole is a semi-trapezoidal opening with the sides at the lower half gradually angled inward such that cleat blocks disposed on a horizontal tube can be positionally engaged therein, but also removed to facilitate adjustments in height.

The brief descriptions of the drawings below are followed by the detailed description of the preferred embodiments of the invention herein.

BRIEF DESCRIPTION OF THE DRAWINGS

FIG. 9-A is a partial cross-sectional drawing of FIG. 9, as viewed from the perspective of line A—A.

FIG. 10A is a cross-sectional drawing of FIG. 10, as viewed from the perspective of line B—B.

FIG. 11-A is an isometric drawing of FIG. 11 shown in a partial, magnified view.

FIG. 13-A is an isometric drawing of FIG. 13 shown in a partial, magnified view.

FIG. 16-A is an isometric drawing of the FIG. 16.

DETAILED DESCRIPTION OF THE INVENTION

Figure 1:
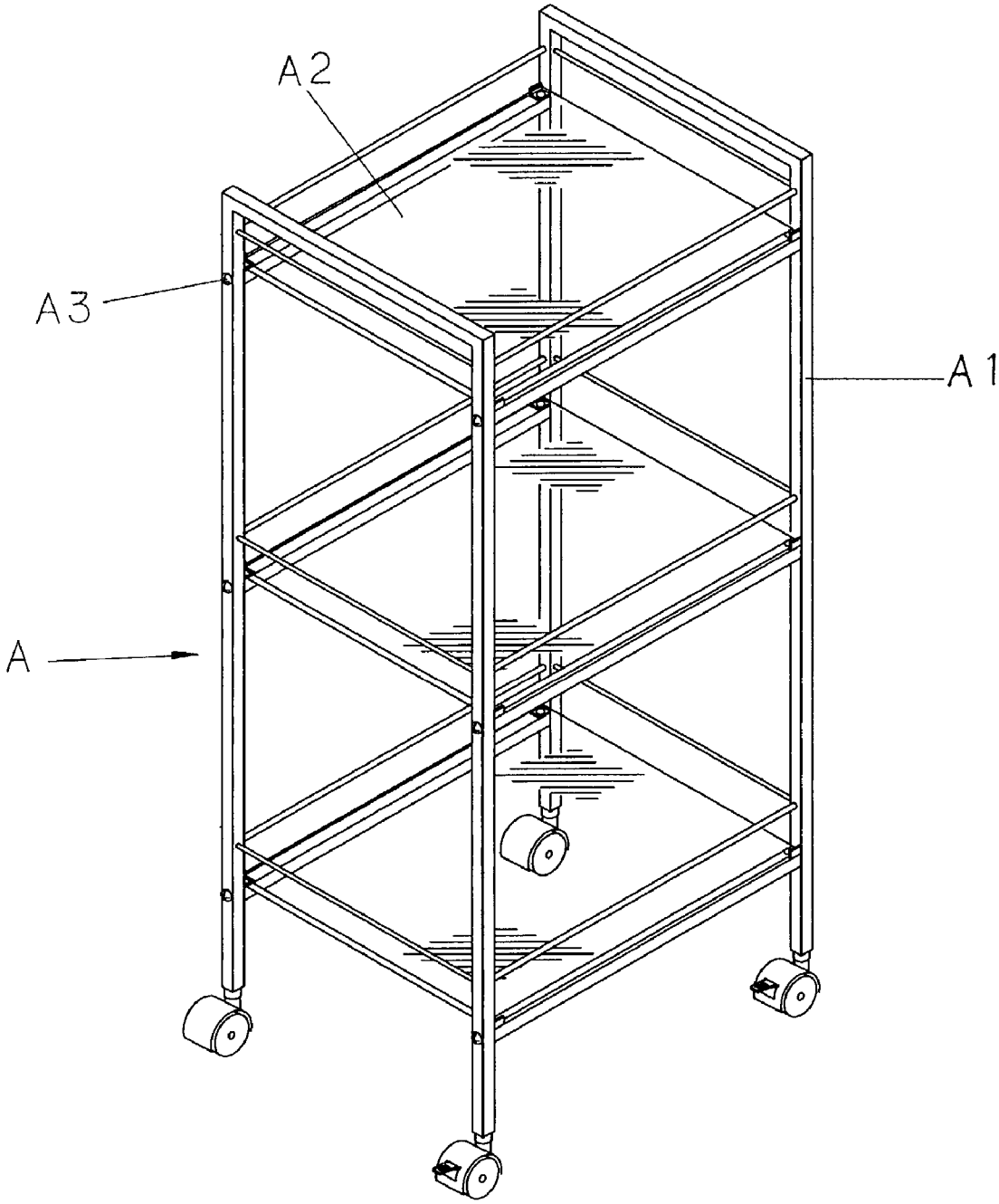
FIG.1 Prior Art
FIG. 1 is an isometric drawing of a conventional shelf rack.
Figure 2:
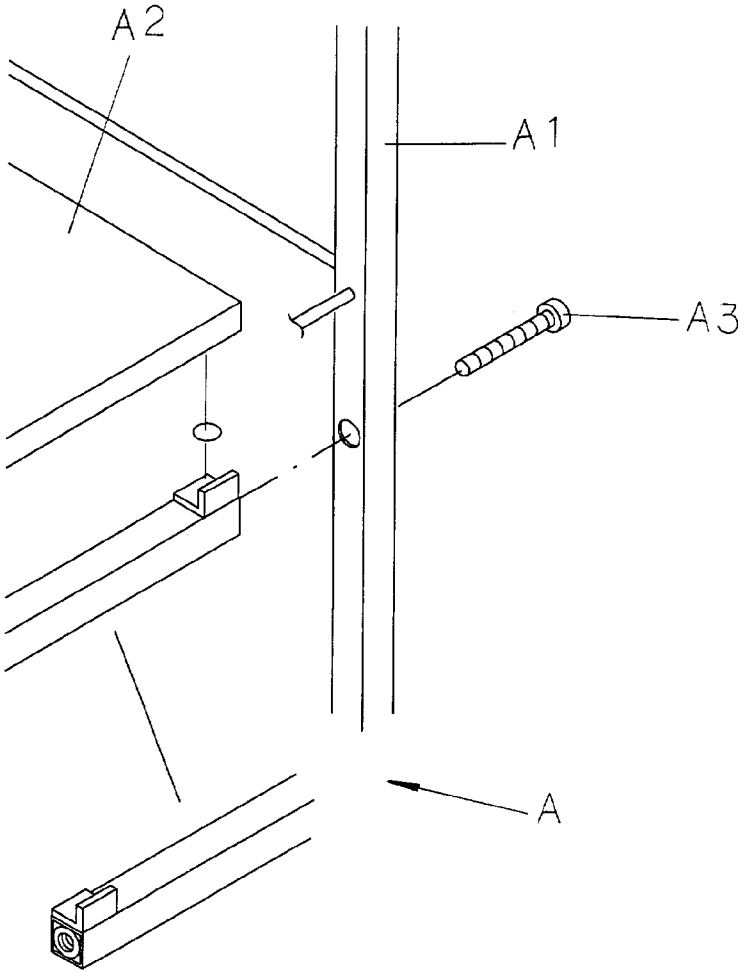
FIG.2 Prior Art
FIG. 2 is an exploded drawing of a section of the conventional shelf rack.
Figure 3:
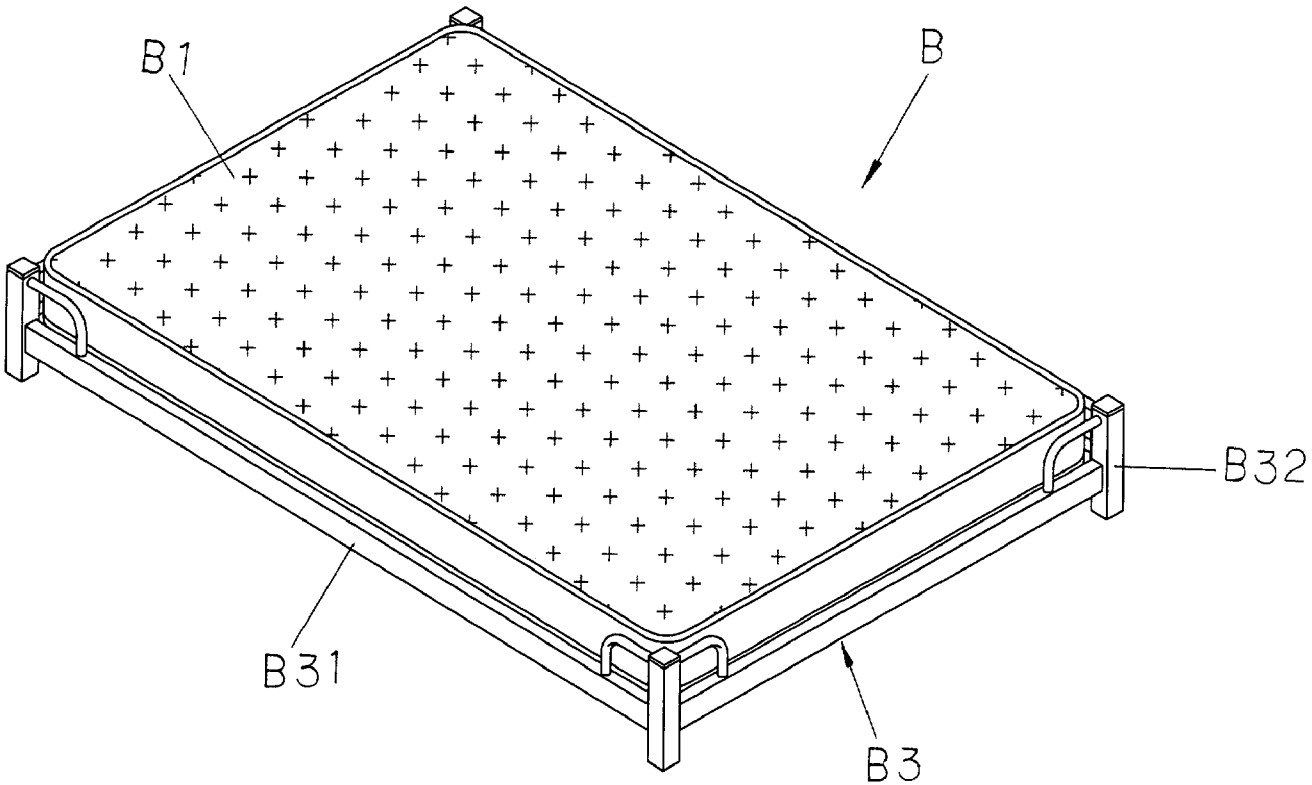
FIG.3 Prior Art
FIG. 3 is an isometric drawing of a conventional bed.
Figure 4:
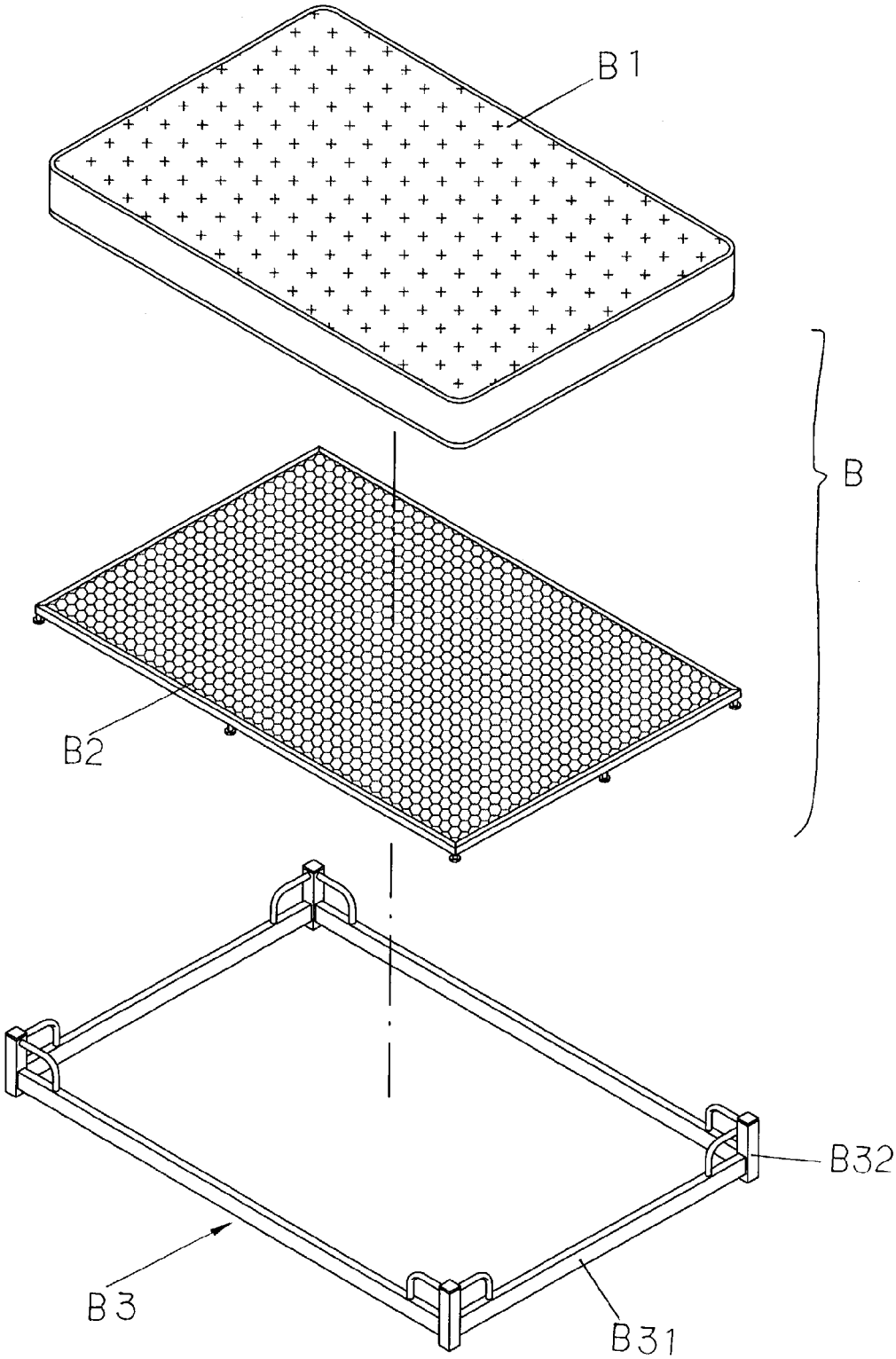
FIG.4 Prior Art
FIG. 4 is an exploded drawing of the conventional bed.
Figure 5:
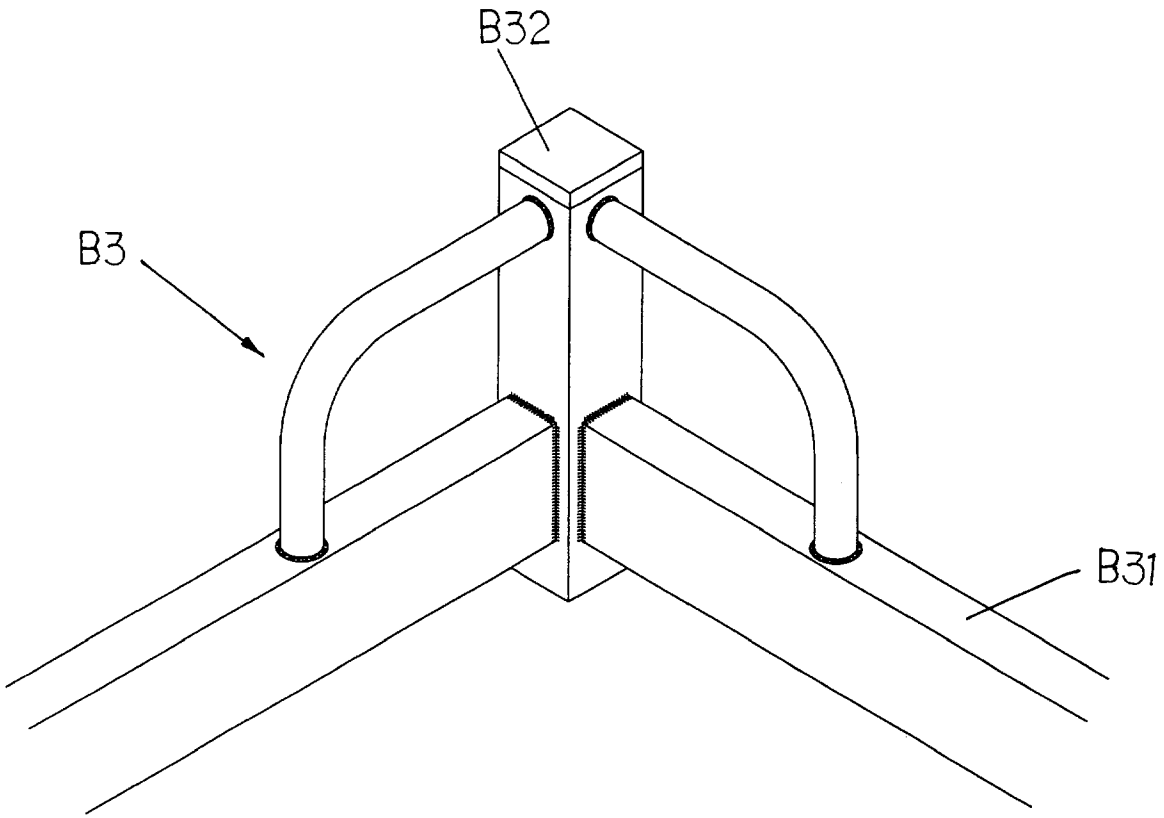
FIG.5 PRIOR ART
FIG. 5 is a isometric drawing of a section of FIG. 3 shown in a partial, magnified view.
Figure 6:
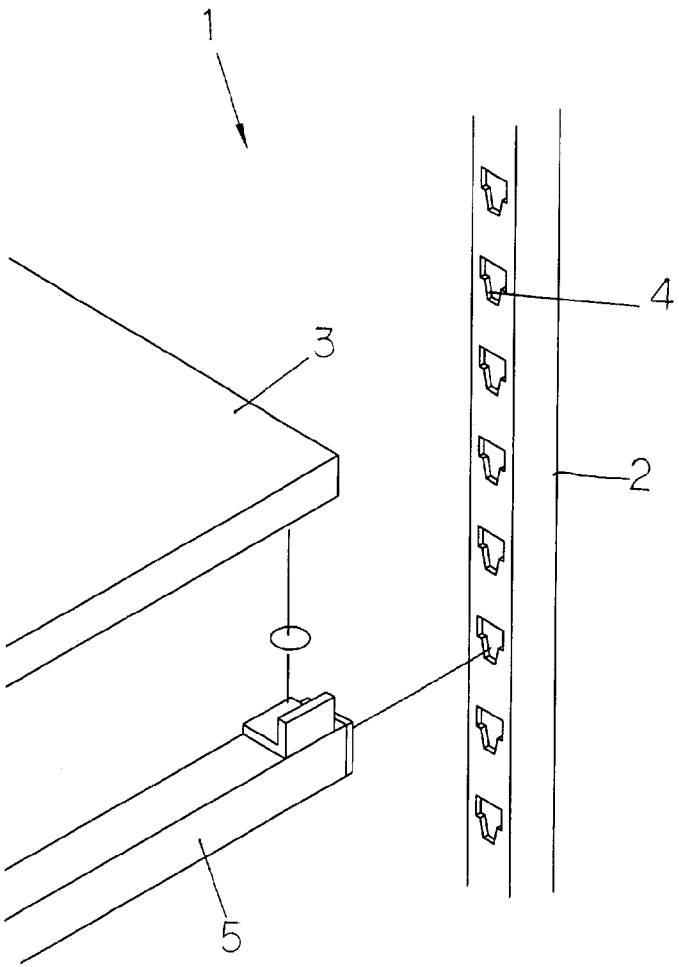
FIG. 6 is an exploded drawing of the invention herein.
Figure 7:
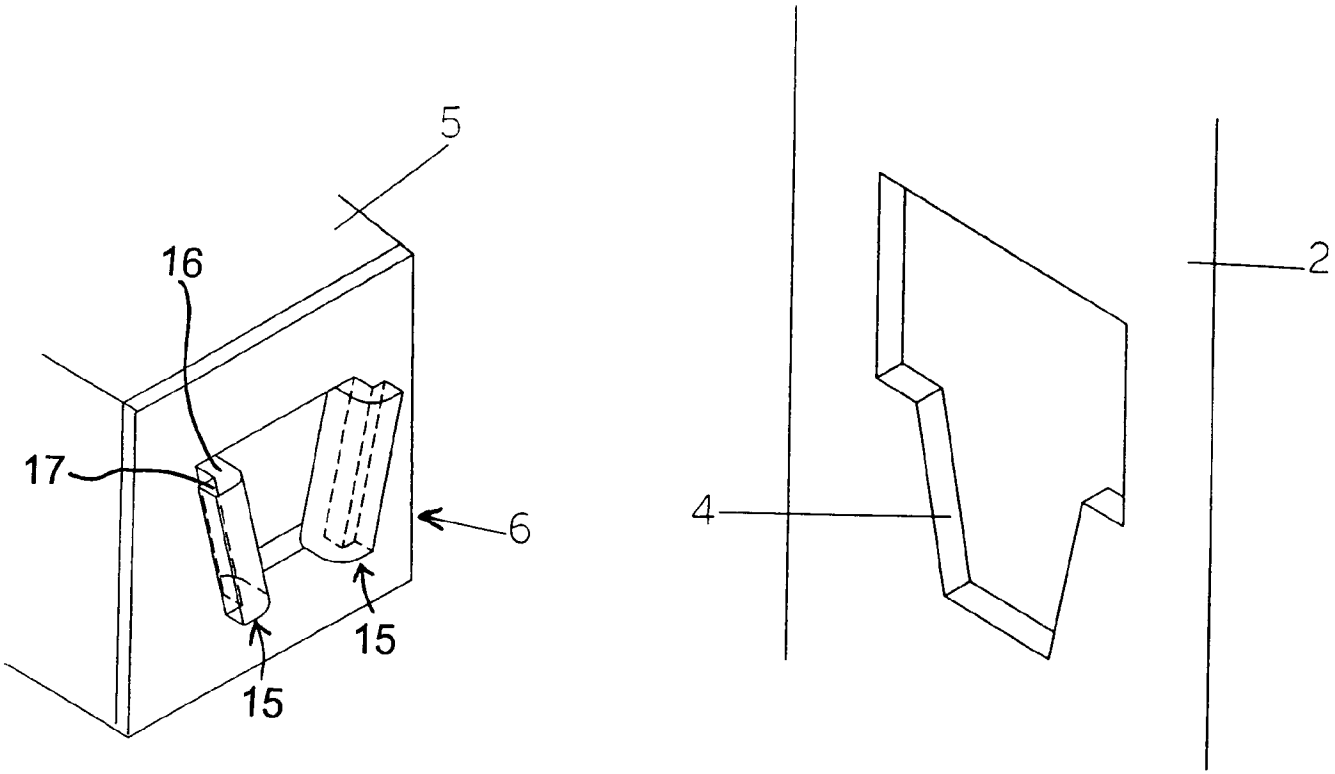
FIG. 7 is an exploded drawing of a section of FIG. 6.

Referring to FIG. 6 and FIG. 7, the exploded drawing of the invention herein, the multi-purpose tubular frame structure consists of a shelf rack 1 having a plurality of adjustable shelves 3 and a series of differing height retaining holes 4 in corner posts 2, the retaining holes 4 providing for the engagement of a cleat block 6 at one extremity of a horizontal tube 5, the major features of which are that each retaining hole 4 in the said corner posts 2 is a semi-trapezoidal opening with the sides at the lower half gradually angled inward. Each cleat block 6 has a trapezoidal configuration, and outwardly projecting coupling flanges 15 on lateral sides thereof. Each coupling flange 15 has essentially an L-shape in cross-section defined by a first lea 16 and a second leg 17. The first legs 16 of the coupling flanges of each cleat block are arranged to correspond to the shape and dimension to the semi-trapezoidal opening, to allow the coupling flanges to be insertable within the selected semi-trapezoidal openings, and the second legs 17 of the coupling flanges of each cleat block define a coupling surface that is slightly larger than the semi-trapezoidal opening, which is engagable with respective interior lateral sides of the semi-trapezoidal openings when the coupling flanges are inserted therein. This achieves rapid conjoinment and assembly.

Figure 8:
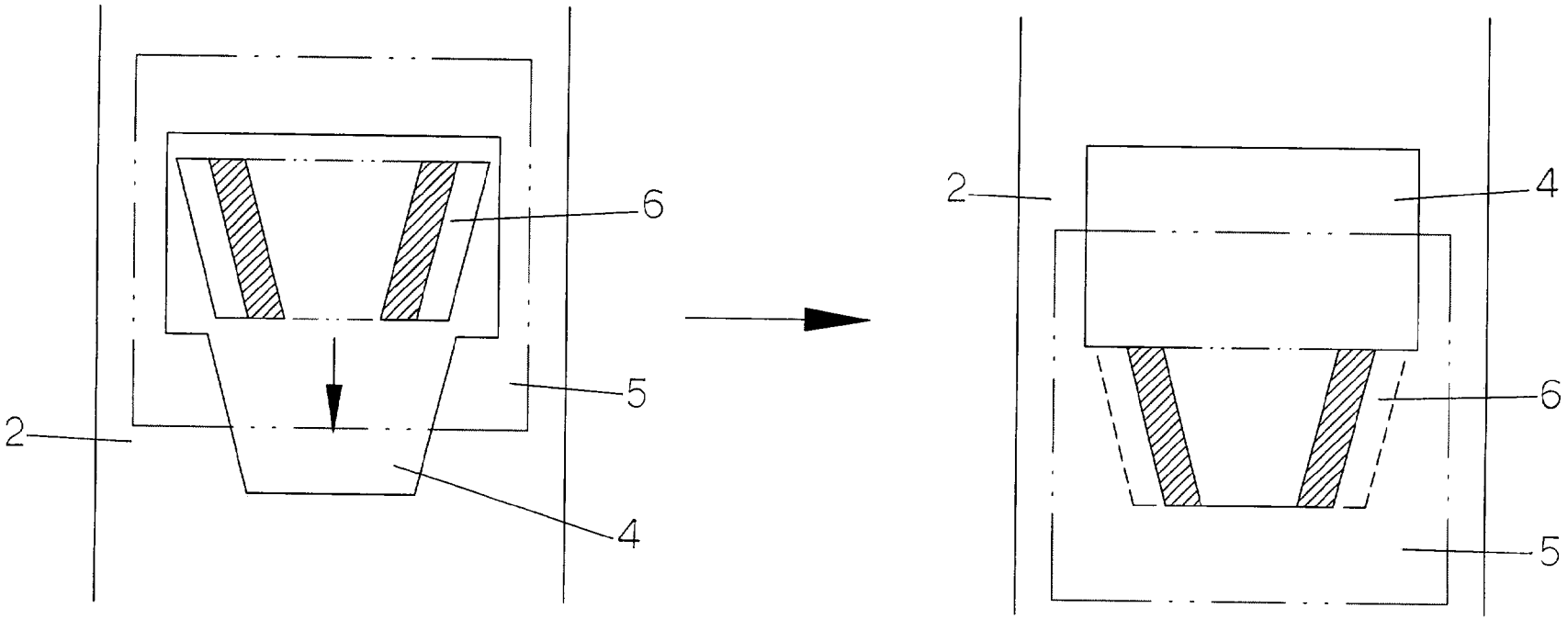
FIG. 8 is an orthographic drawing of FIG. 6. that illustrates assembly.
Figure 9:
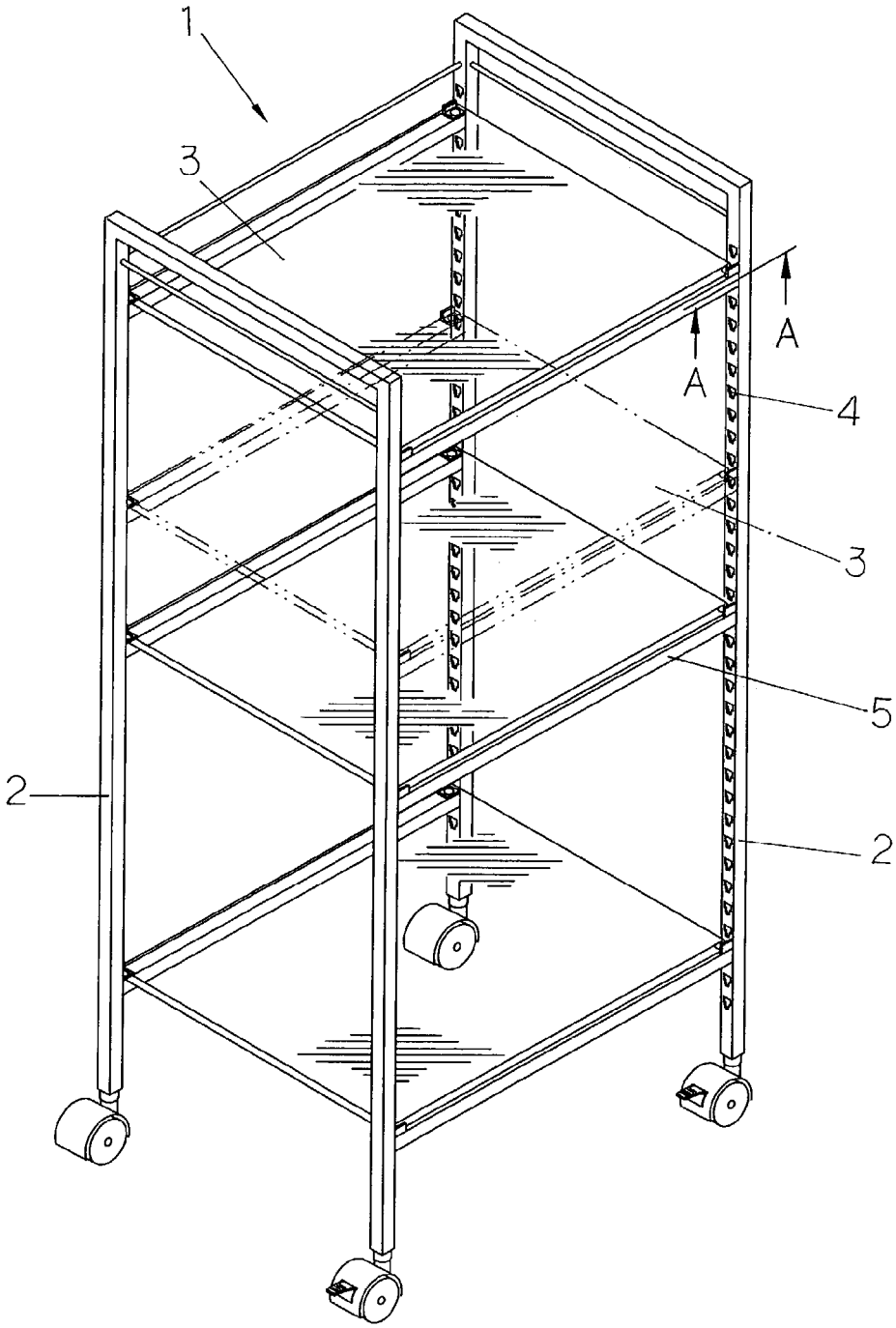
FIG. 9 is an isometric drawing of the shelf rack of the invention herein.

Refer to FIG. 7, FIG. 8, FIG. 9, and FIG. 9-A, the exploded drawing of the invention herein, the orthographic drawing of the invention herein that illustrates assembly, the isometric drawing of the invention herein, and the partial cross-sectional drawing of the invention herein.

When the user wants to assemble the shelf rack 1, the cleat block 6 at one extremity of the horizontal tube 5 is inserted into one of the retaining holes 4 in the said corner posts 2 (as shown in FIG. 7); since one lateral surface of the cleat block 6 is proportional to the semi-trapezoidal opening, it becomes engaged into position within the semi-trapezoidal opening, which has sides at the lower half gradually angled inward (as shown in FIG. 9-A), during the process of insertion into the retaining hole 4 (as shown in FIG. 8); the shelf rack 1 of the invention herein is not only rapidly assembled, but when the user wants to alter the height of the shelves 3, the design of the retaining holes 4 and cleat block 6 enable control over such adjustment.

Figure 10:
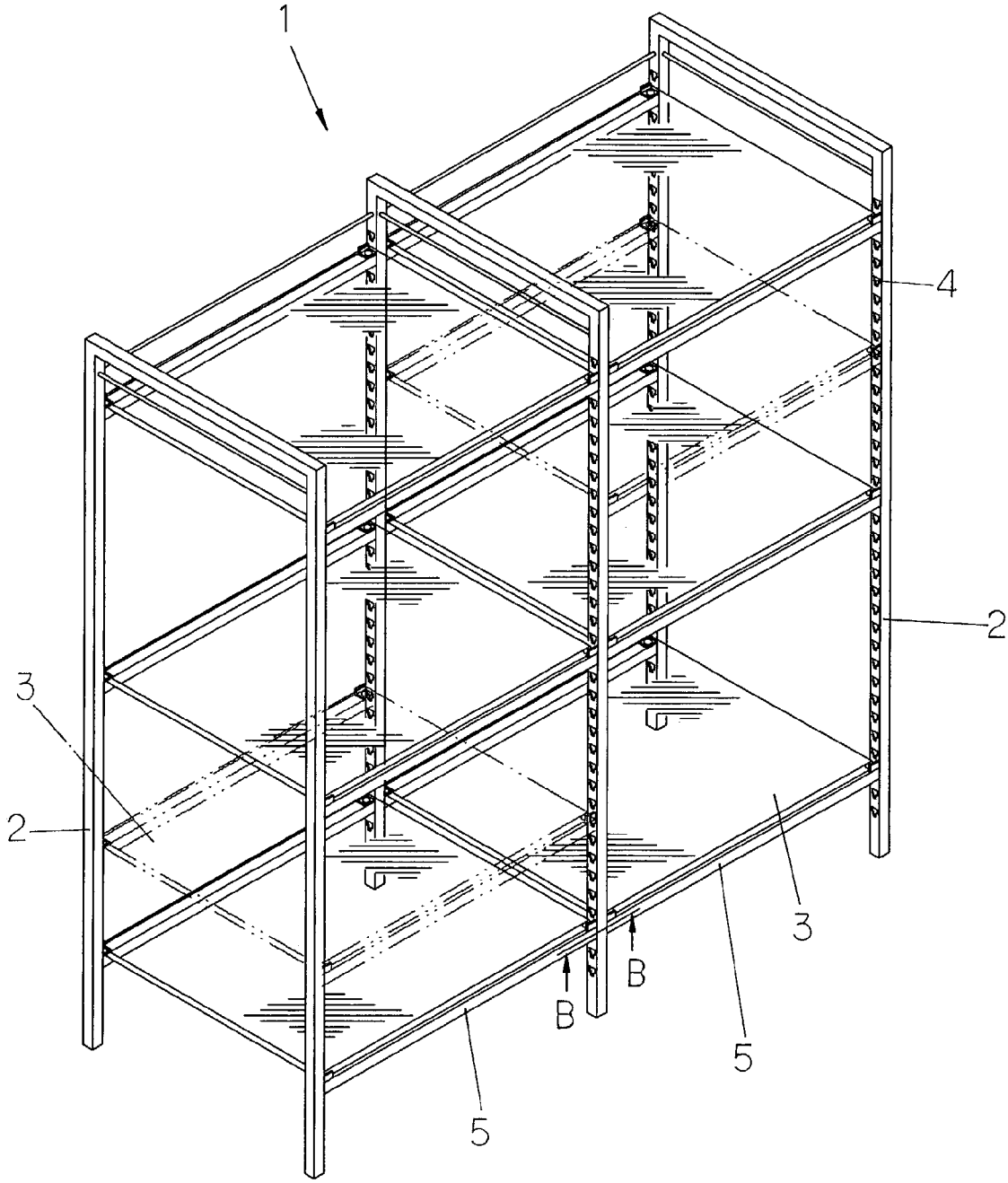
FIG. 10 is an isometric drawing of the interconnected shelf racks of the invention herein.

Refer to FIG. 10 and FIG. 10-A, the isometric and the cross-sectional drawing of the interconnected shelf racks of the invention herein.

Two shelf racks 1 of the invention here can be combined into a single structural entity (as shown in FIG. 10); the plurality of retaining holes 4 along the two sides of the corner posts 2 enable the insertion of the cleat blocks 6 at the two extremities of the horizontal tube 5 into the retaining holes 4 (as shown in FIG. 10-A), the design of the retaining holes 4 and the cleat blocks 6 facilitating rapid engagement and positioning as well as an assembled shelf rack having even more overall stability and in which the height of shelves 3 are adjustable as required.

Figure 11:
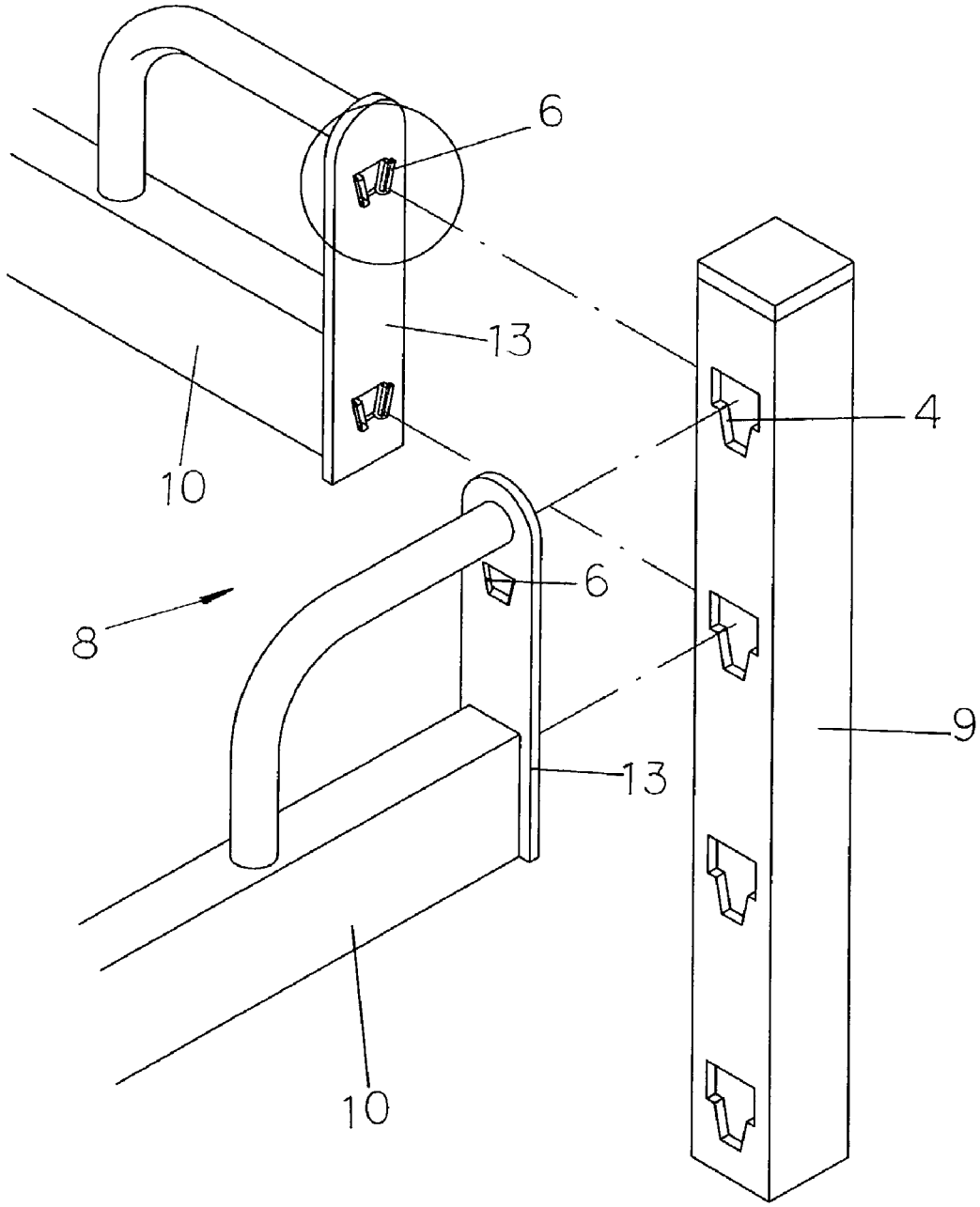
FIG. 11 is an exploded drawing of the bed embodiment of the invention herein.
Figure 12:
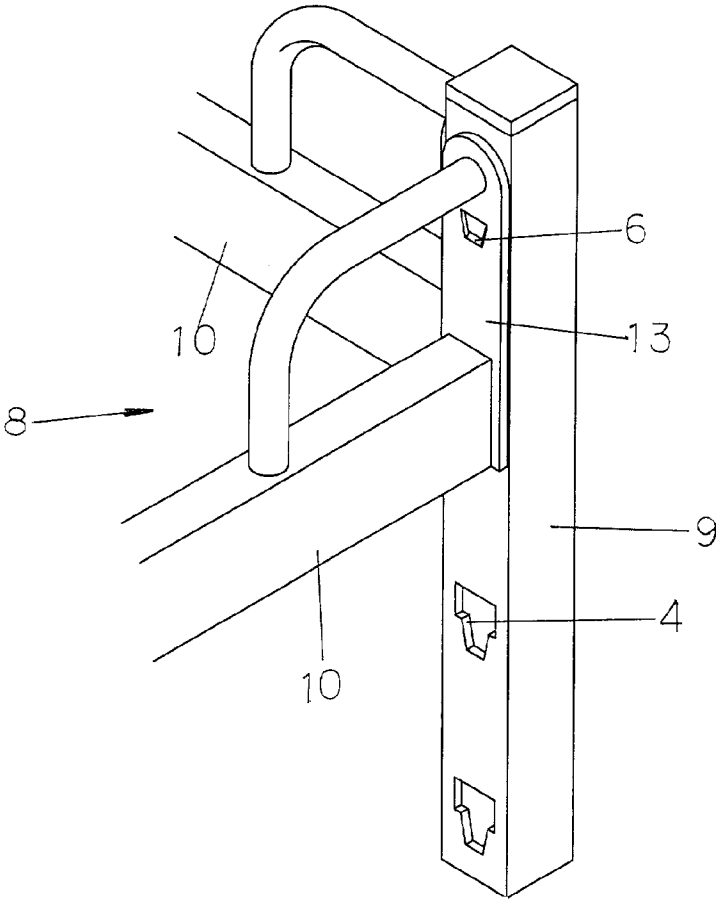
FIG. 12 is an isometric drawing of FIG. 11.

Refer to FIG. 11, FIG. 11-A, and FIG. 12, the exploded drawing of another embodiment of the invention herein, the isometric drawing of the other embodiment of the invention herein shown in a partial, magnified view, and the isometric drawing of the other embodiment of the invention herein.

Another application of the invention herein is a bed 7 frame 8 in which a plurality of retaining holes 4 is formed in the support post 9, each retaining hole 4 consisting of a semi-trapezoidal opening with the sides at the lower half gradually angled inward, and cleat blocks 6 (each as shown in FIG. 11-A) disposed on an I-shaped member 13 at one extremity of a square tube 10 that are inserted and engaged into position to build the bed 7 frame 8 (as shown in FIG. 12); when the user wants to adjust the height of the bed 7, the cleat blocks 6 of the square tube 10 are moved to the desired retaining holes 4 of the support post 9 to thereby change the height of the bed 7.

Figure 13:
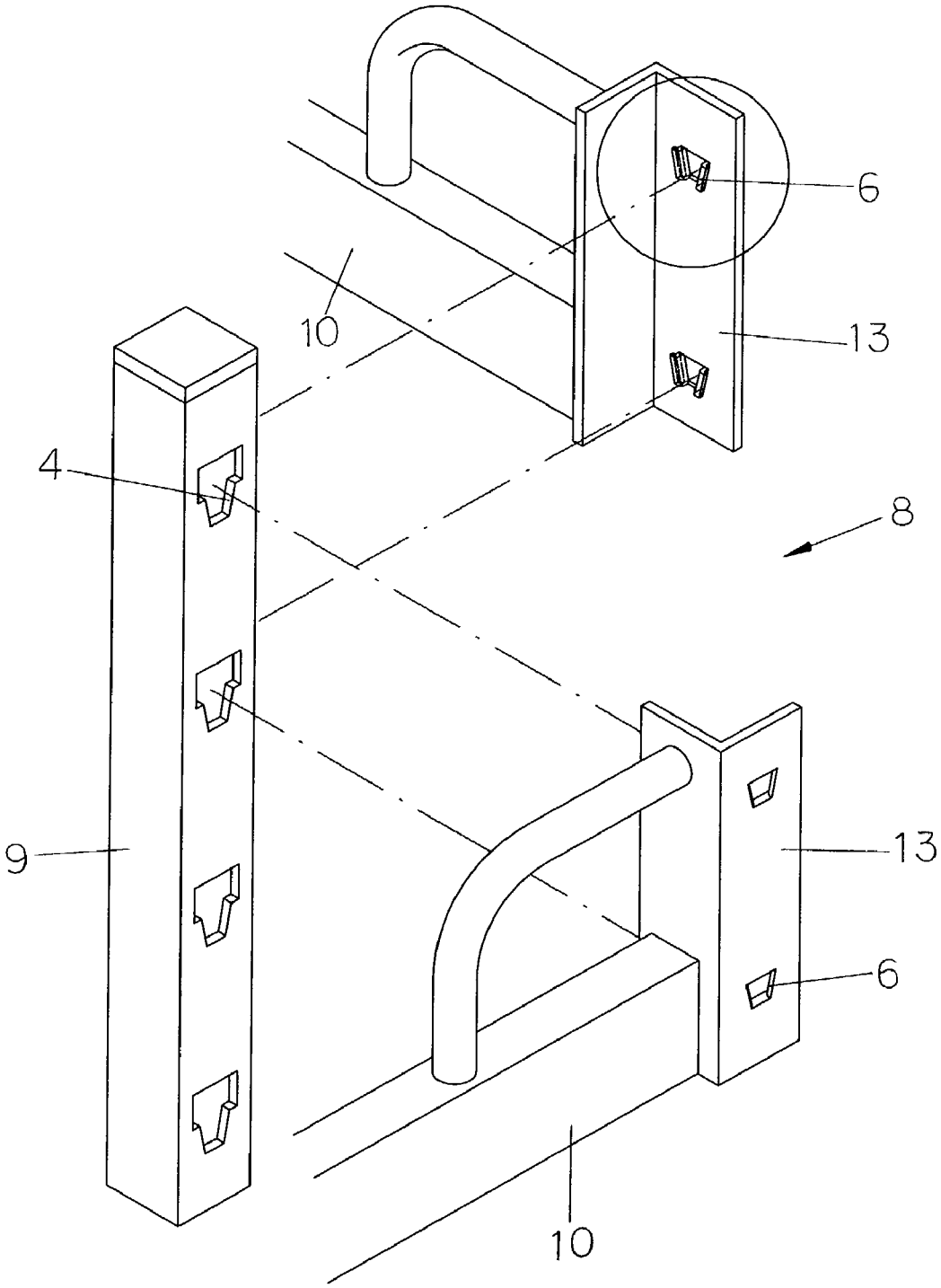
FIG. 13 is an exploded drawing of another bed embodiment of the invention herein.
Figure 14:
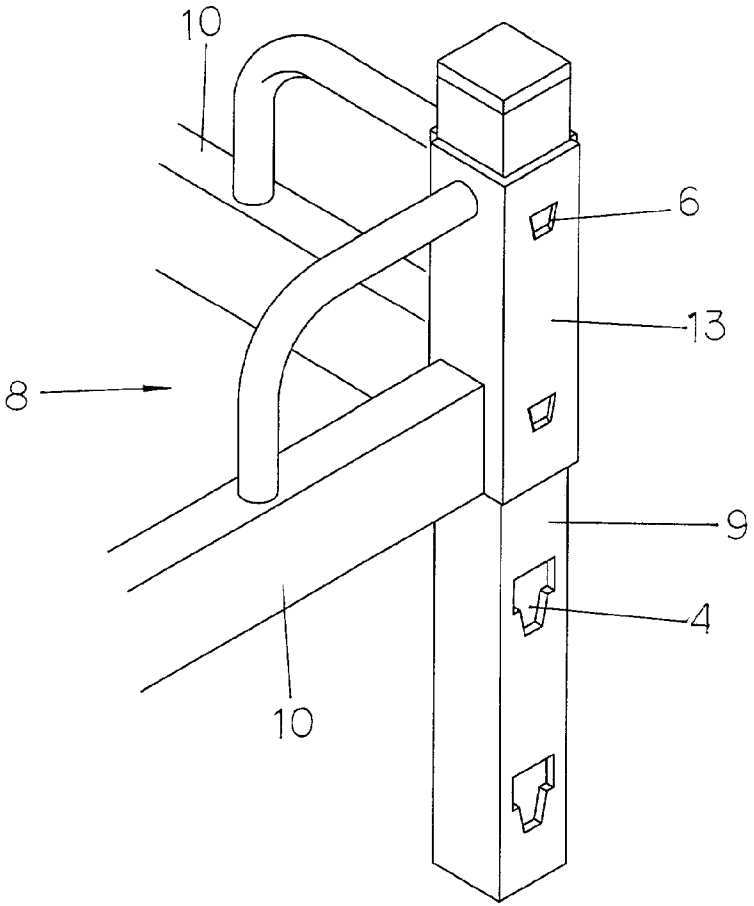
FIG. 14 is an isometric drawing of FIG. 13.

Refer to FIG. 13, FIG. 13-A, and FIG. 14, the exploded drawing of another bed embodiment of the invention herein, the isometric drawing of the other bed embodiment of the invention herein shown in a partial, magnified view, and an isometric drawing of the other embodiment of the invention herein.

In another embodiment of the square tube 10 of the bed 7 frame 8 of the invention herein, the said member 13 can be an L-shaped member 13, the said member 13 having a plurality of cleat blocks 6 disposed on it (as shown in FIG. 13-A) for engaged positioning and, furthermore, the design of the L-shaped member 13 affords additional support strength and coupling, while also enabling control over height adjustment as required.

Figure 15:
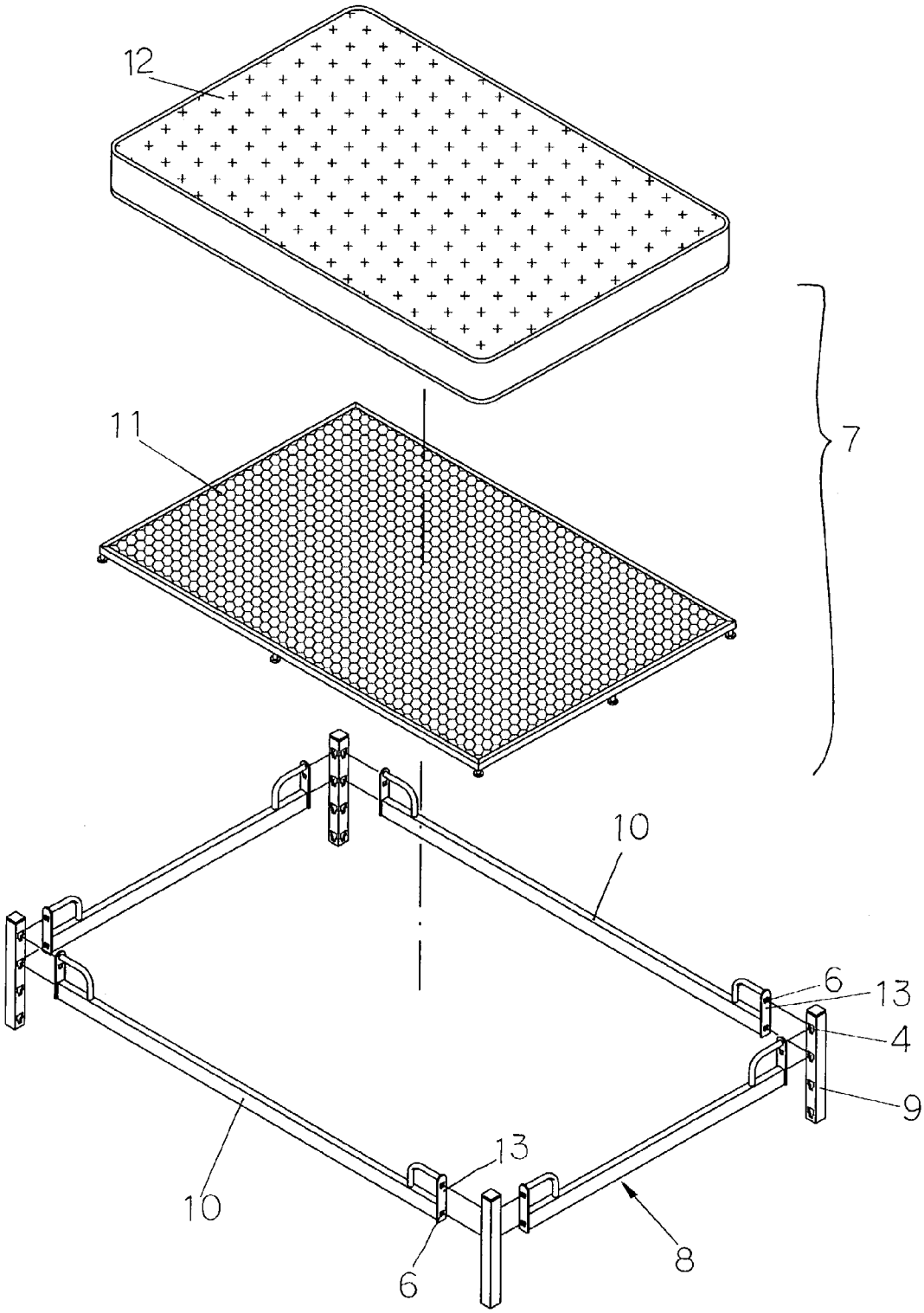
FIG. 15 is an exploded drawing of the bed assembly of the invention herein.
Figure 16:
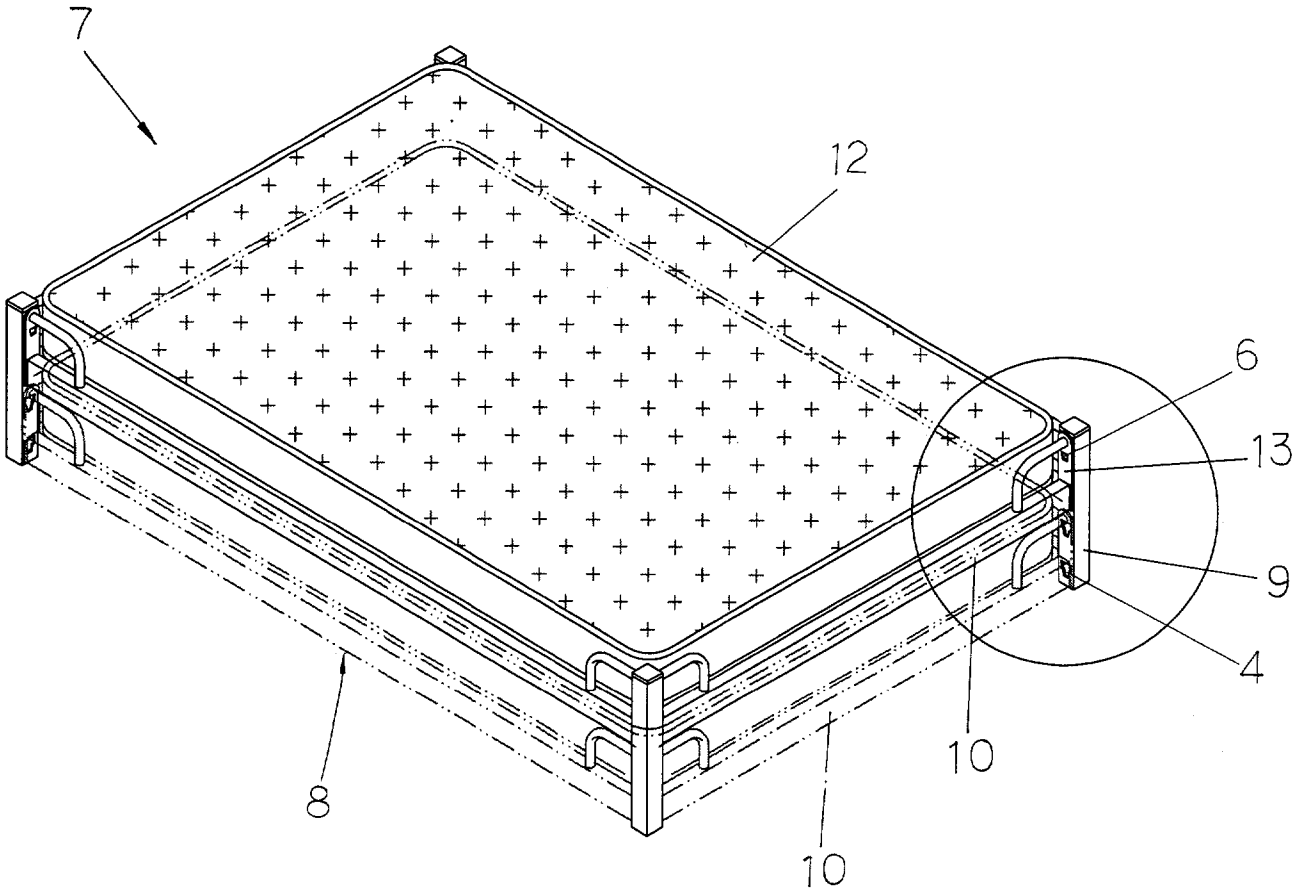
FIG. 16 is an isometric drawing of the bed embodiment of the invention herein.

Refer to FIG. 15, FIG. 16, and FIG. 16-A, the exploded drawing of the bed assembly of the invention herein, the isometric drawing of the assembly of invention herein, and the isometric drawing of the invention herein shown in a partial, magnified view.

When the user assembles the bed 7, the support post 9 retaining holes 4 and the square tube 10 cleat blocks 6 are brought into engagement to assemble the frame 8, following which a cushioning layer 11 and a mattress 12 (as shown in FIG. 15) are placed onto the frame 8 to complete the bed 7 (as shown in FIG. 16) such that when the user wants to adjust the bed 7, the cleat blocks 6 of the square tube 10 are moved to the desired retaining holes 4 of the support post 9 (as shown in FIG. 16-A) to thereby alter the height of the bed 7.

Figure 17:
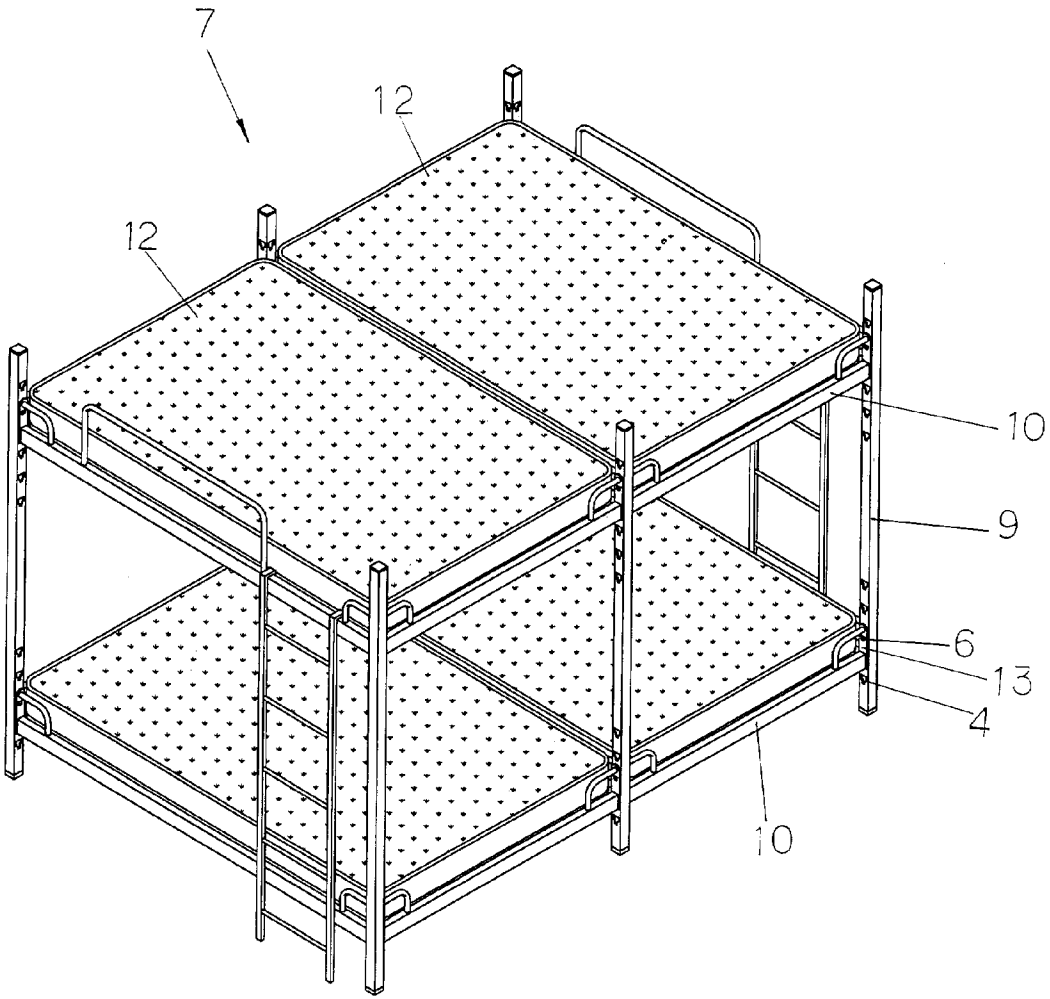
FIG. 17 is an isometric drawing of the interconnected bed embodiment of the invention herein.
Figure 18:
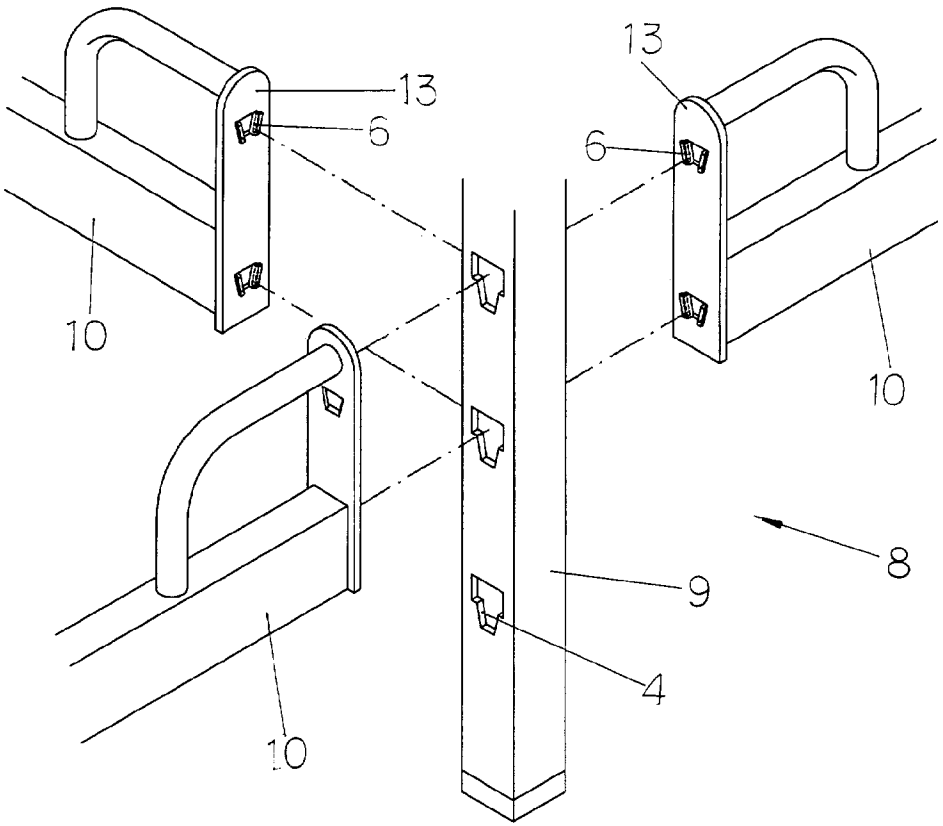
FIG. 18 is an exploded drawing of the frame in FIG. 17.

Refer to FIG. 17 and FIG. 18, the isometric drawing of the interconnected bed embodiment of the invention herein and the exploded drawing of the interconnected bed embodiment of the invention herein.

The bed 7 of the invention herein can be assembled together into two sets of beds (as shown in FIG. 17), wherein the plurality of retaining holes 4 in the surface of the support post 9 are conjoined and engaged at the square tube 10 cleat blocks 6 to build an interconnected frame 8 such that when variation of the bed height is desired, this is accomplished by adjusting the position at the retaining holes 4 and the cleat blocks 6 and, furthermore, the beds can be disassembled as necessary to conserve space.

To enable a further understanding of the invention herein by the examination committee, the utility and advantages of the invention are as follows:

(1) The invention herein is assembled by the interlocking conjoinment of the cleat blocks 6 and the retaining holes 4 and, as such, whether assembled into a shelf rack or a bed, the height is adjustable as per requirements.

(2) The conjoined assembly of the invention herein not only affords control over height adjustment as required, but also has the advantage of disassembly for shipping, which reduces the overall material dimensions and lowers shipping costs such that manufacturers do not have to pass the said cost to consumers.

In summation of the foregoing section, since the invention herein utilizes the advantages of an interlocking assembly to provide control over height adjustment as required and, furthermore, in a structural embodiment that is of greater simplicity and stability which affords an increase in overall practicality, the present invention meets new patent application requirements and is submitted for review.

What is claimed is:

1. A multi-purpose tubular frame structure, comprising:

a shelf rack having:

an adjustable shelf;

a horizontal tube that supports the shelf, and having a cleat block at respective extremities thereof, each said cleat block having a trapezoidal configuration, and outwardly projecting coupling flanges on lateral sides thereof, each coupling flange having essentially an L-shape in cross-section defined by a first leg and a second leg; and a plurality of corner posts, each having a series of differing height retaining holes therein, the retaining holes providing for the engagement of a respective cleat block, each retaining hole being a semi-trapezoidal opening with the sides at a lower half being gradually angled inward, and the first legs of the coupling flanges of each cleat block are disposed to correspond to a shape and dimension to the semi-trapezoidal opening, to allow the flanges to be insertable within the selected semi-trapezoidal openings, and the second legs of the coupling flanges of each cleat block define a coupling surface that is slightly larger than the semi-trapezoidal opening, which is engagable with respective interior lateral sides of the semi-trapezoidal openings when the flanges are inserted therein.

* * * * *